US006917342B2

(12) United States Patent
Thudor et al.

(10) Patent No.: US 6,917,342 B2
(45) Date of Patent: Jul. 12, 2005

(54) ANTENNA SYSTEM FOR THE TRANSMISSION OF ELECTROMAGNETIC SIGNALS

(75) Inventors: Franck Thudor, Rennes (FR); Philippe Minard, Rennes (FR); Ali Louzir, Rennes (FR); Francoise Le Bolzer, Rennes (FR)

(73) Assignee: Thomson Licensing S.A., Boulogne-Billancourt (FR)

( * ) Notice: Subject to any disclaimer, the term of this patent is extended or adjusted under 35 U.S.C. 154(b) by 0 days.

(21) Appl. No.: 10/280,495

(22) Filed: Oct. 25, 2002

(65) Prior Publication Data

US 2003/0080912 A1 May 1, 2003

(30) Foreign Application Priority Data

Oct. 29, 2001 (FR) ..... 01 13955
Apr. 30, 2002 (FR) ..... 02 05419

(51) Int. Cl.[7] ..... H01Q 13/10; H01Q 13/12
(52) U.S. Cl. ..... 343/770; 343/769; 343/700 MS
(58) Field of Search ..... 343/767, 770, 343/769, 700 MS

(56) References Cited

U.S. PATENT DOCUMENTS 6,573,872 B2 * 6/2003 Oberschmidt et al. ..... 343/767
6,593,895 B2 * 7/2003 Nesic et al. ..... 343/795
2003/0034929 A1 * 2/2003 Bolzer et al. ..... 343/770
2004/0113841 A1 6/2004 Louzir et al.

FOREIGN PATENT DOCUMENTS

EP 0685901 12/1995 ..... H01Q/21/20
JP 3-024804 2/1991 ..... H01Q/7/00
JP 3-024805 2/1991 ..... H01Q/11/08

OTHER PUBLICATIONS

Patent Abstracts of Japan, vol. 015, No. 148, Apr. 15, 1991 and JP 03–024804.
Patent Abstracts of Japan, vol. 015, No. 148, Apr. 15, .
K. Hirose et al "Dual–Loop Slot Antenna with Simple Feed", Electronics Letters, IEE Stevenage, vol. 25, No. 18, Aug. 13, 1989, pp. 1218–1219.

* cited by examiner

*Primary Examiner*—Tan Ho
(74) *Attorney, Agent, or Firm*—Joseph S. Tripoli; Joseph J. Laks; Robert D. Shedd

(57) ABSTRACT

The invention relates to a device for receiving and/or transmitting electromagnetic signals comprising three annular slots (20, 21, 22) which are tangent in pairs at two points P1 and P2. These slots are supplied by two supply lines (23, 24) so as to produce a line/slot transition. One of the lines 23 passes through the point P1 while the other line 24 passes through the point P2, the two lines being connected via a T-shaped junction at a common port 1. A diode 25 or 26 is mounted at the free end of each line, making it possible to simulate a short circuit or an open circuit at the end of one of the lines and an open circuit or a short circuit at the end of the other line.

14 Claims, 5 Drawing Sheets

PRIOR ART

ANTENNA SYSTEM FOR THE TRANSMISSION OF ELECTROMAGNETIC SIGNALS

This application claims the benefit under 35 U.S.C. §365 of French patent application No. 0113955 filed Oct. 29, 2001 and French patent application No. 0205419 filed Apr. 30, 2002.

FIELD OF THE INVENTION

The present invention relates to an antenna system for the transmission of electromagnetic signals which can be used in the field of wireless transmissions, especially in the case of transmissions in a closed or semi-closed environment such as domestic environments, gymnasia, television studios, cinemas and theatres, or the like.

BACKGROUND OF THE INVENTION

In known high bit rate wireless transmission systems, the signals transmitted by the transmitter reach the receiver along a plurality of different paths. When they are combined at the receiver, the phase differences between the various rays having travelled paths of different lengths give rise to an interference pattern likely to cause fading or significant degradation of the signal.

Furthermore, the location of the fading changes over time depending on changes in the environment such as the presence of new objects or the passage of people. This fading due to the multiple paths may lead to significant degradation, in terms of both the quality of the signal received and system performance.

To combat fading, the technique most often used is a technique with spatial diversity. This technique consists inter alia in using a pair of antennas with large spatial coverage such as two antennas of the patch type combined with a switch. The two antennas are separated by a length which must be greater than or equal to $\lambda_0/2$ where $\lambda_0$ is the wavelength corresponding to the operating frequency of the antenna. With this type of antenna, it is possible to demonstrate that the probability of having both antennas simultaneously in a region of fading is very low. Furthermore, by virtue of the switch, it is possible to select the branch connected to the antenna having the highest signal level by examining the signal received via a control circuit.

The above solution has the main drawback of being relatively bulky. Consequently, the applicant has proposed various alternative solutions to the solution described above. These solutions are applicable to antennas of the slot type supplied by a line/slot transition and which make it possible to obtain radiation diversity.

Research has therefore been carried out on an antenna of the slot type, such as an annular slot supplied by a tangential line/slot transition. An antenna of this type is shown in FIG. 1. This antenna is produced on a substrate 1 such as the Chukoh Flo CGP500 substrate where Er=2.6, TanD=0.0018 and the height h=0.76 mm. It comprises an annular slot 2, the perimeter of which is of the order of $k'\lambda_s$ where k' is an integer and $\lambda_s$ the wavelength guided in the slot.

As shown in FIG. 1, this annular slot 2 is supplied by a line/slot transition which is substantially tangential at the point P. The line/slot transition consists of a microstrip line 3 made on the substrate 1, this microstrip line being at a distance y from the point of tangency to the slot 2. The length of the microstrip line 3 between its end 3' and the point P is about $k\lambda_m/4$, where k is an odd integer and $\lambda_m$ the wavelength guided in the microstrip line. Furthermore, the characteristic impedance of the microstrip line is chosen so as to provide 50 ohms at the port 1. In this case, the coupling between the slot and the microstrip line is of electromagnetic type. To have maximum coupling between the exciting microstrip line and the slot, it is necessary to be placed in a short-circuit plane for the microstrip line. Thus, the coupling is optimized by adjusting the distance y between the slot 2 and the exciting line 3. Since the coupling takes place over a certain region on either side of the short-circuit plane for the microstrip line, broadband behaviour is obtained for the antenna excited in this way, as given in Table 1 below:

TABLE 1

| Y (mm) | −0.25 | 0 | +0.25 | +0.5 |
|---|---|---|---|---|
| Matched bandwidth (%) | 14.3 | 14 | 12 | 9.5 |

FIG. 2 also shows the reflection coefficient S11 of an annular slot 2 as a function of the frequency for the various values of y given in Table 1. These curves give the matching of the annular slot to the said values. In this research, it is simply mentioned that two annular slots excited symmetrically by a tangential supply line radiate in phase opposition. This therefore results in radiation in the zero axis.

However, contrary to this assertion, the applicant has noticed that, in a structure of the above type with positioning of the microstrip line with respect to the slots so that one is in a short-circuit plane of the microstrip line, the two annular slots radiate in phase, which gives constructive radiation along the axis having linear polarization of very high purity.

SUMMARY OF THE INVENTION

The present invention therefore relates to an antenna system for the transmission of electromagnetic signals using slot-type antennas supplied by a line/slot transition as described above, making it possible to obtain compact antennas with a broad frequency band, and with linear polarization of very high purity.

The present invention also relates to a novel topology of antennas as described above, making it possible to obtain a compact device with radiation diversity on reception.

The subject of the present invention is an antenna system for the transmission of electromagnetic signals comprising a first means for the transmission of signals of the slot antenna type and a first supply line for connecting the said first means to means of exploiting signals, the first supply line being electromagnetically coupled by a line/slot transition to the first means for the transmission of signals of the slot antenna type, characterized in that it comprises a second means for the transmission of signals of the slot antenna type which is symmetric with the first means with respect to a first point P, the second means being electromagnetically coupled by a line/slot transition with the said first supply line which is in a plane passing through the first point of symmetry, the said transition being close to the short-circuit plane of the supply line.

With this structure, it is possible to obtain an antenna with a linear polarization of high purity.

According to another feature of the present invention, the first and second means for the transmission of signals of the slot antenna type are provided with perturbations positioned at around 45 or 135 degrees from the plane passing through the centre of said means of transmission and the first point of symmetry. The addition of perturbations transforms the linear polarization into a right or left circular polarization according to the chosen angle.

According to another feature of the present invention, making it possible to obtain radiation diversity in transmission, the system comprises a third means for the transmission of electromagnetic waves of the slot antenna type supplied by a line/slot transition which is symmetric with one of the two electromagnetic wave transmission means with respect to a second point and a second supply line connected in common with the first supply line to means of exploiting signals, the second supply line being electromagnetically coupled to the electromagnetic wave transmission means of the slot antenna type supplied by a line/slot transition and being in a plane passing through the second point of symmetry, the free end of the first and of the second supply lines being connected to a component making it possible to simulate a short circuit or an open circuit at the end of one of the lines and an open circuit or a short circuit at the end of the other line.

According to an additional feature of the invention, the length of each supply line between the component and the point of symmetry is about $k\lambda_m/4$ where k is an integer and $\lambda_m$ the wavelength guided in the line, so as to restore an electrical short-circuit or open-circuit plane depending on the state of the component in the plane containing the points of symmetry. In this case, if the line measures $k\lambda_m/4$ where k=2, it is enough to reverse the diode state in order to find the same behaviour. Thus, for k=1, an on diode (CC) plus a quarter-wavelength line gives an open circuit CO at the transition and, for k=2, an off diode (CO) plus a half-wavelength line gives an open circuit.

According to another feature of the invention, the means for the transmission of electromagnetic waves of the slot antenna type supplied by a line/slot transition consist of a slot of annular or polygonal shape, it being possible for the polygonal shape to be a rectangle or a square or any other known polygonal shape.

Furthermore, the perimeter of the slot has a wavelength of about $k'\lambda_s$ where k' is an integer and $\lambda_s$ the wavelength guided in the slot.

According to another additional feature of the present invention, the device further comprises a third supply line connected to a transmission means and electromagnetically coupled to the central electromagnetic wave transmission means by a line/slot transition.

According to preferred embodiments, the component consists of a diode, a transistor, an electronic switch and a microelectromechanical system. Furthermore, the supply lines are produced using microstrip technology or coplanar technology.

DESCRIPTION OF THE FIGURES

Other features and advantages of the present invention will become apparent on reading various embodiments, this reading being carried out with reference to the appended drawings, in which.

To simplify the description, the same elements bear the same references. In the present invention, the term "electromagnetic wave transmission means" refers to any means capable of transmitting and/or of receiving electromagnetic waves, these means being known by the term "antenna".

DESCRIPTION OF PREFERRED EMBODIMENTS

Figure 3:
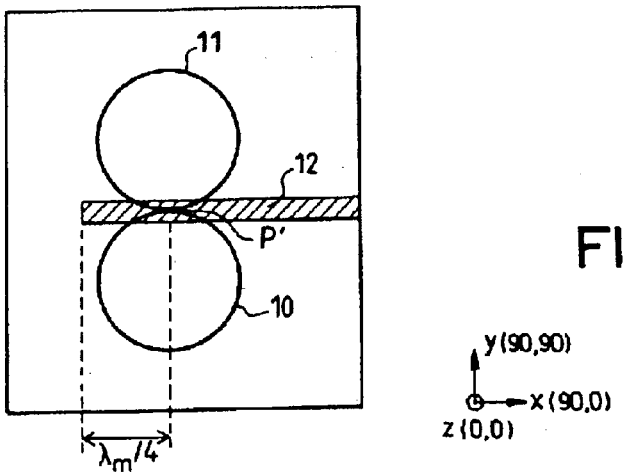
FIG. 3 is a schematic top plan view of two annular slots with tangential supply according to a first embodiment.

An embodiment making it possible to obtain a broadband antenna system with very pure linear polarization will first of all be described with reference to FIGS. 3, 3A and 3B. As shown in FIG. 3, the antenna system comprises slot-type antennas consisting of two annular slots 10, 11 placed on each side of a microstrip supply line 12 which is tangent at a point P' to the two slots 10 and 11. In this case, the two annular slots are supplied by a line/slot transition giving magnetic coupling between the supply line (12) and the slots. The length of the supply line between its end away from the input port and the point of tangency is about $k\lambda_m/4$ where k is an odd integer and $\lambda_m$ the wavelength guided by the microstrip line.

Figure 1:
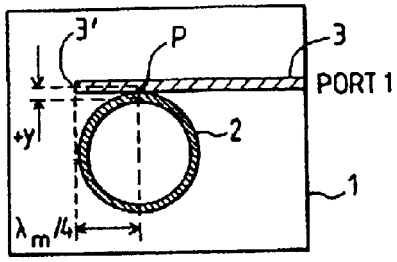
FIG.1 PRIOR ART
FIG. 1, already described, is a schematic top plan view of an annular slot supplied tangentially according to the prior art.
Figure 2:
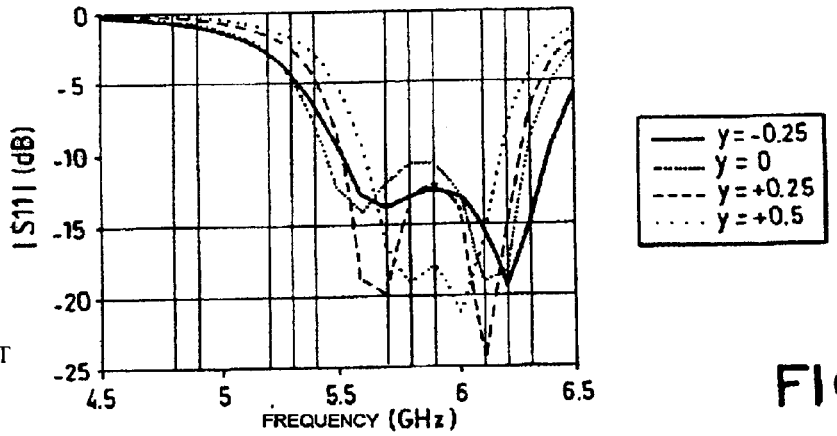
FIG. 2 shows curves giving the reflection coefficient S11 as a function of the frequency of an annular slot for various values of y, for the device of FIG. 1.

As in the case of FIG. 1, the perimeter of each annular slot 10, 11 is substantially equal to $k'\lambda_s$ where k' is an integer and $\lambda_s$ the wavelength guided in the slot. With this structure, since the elliptical polarizations of each slot 10, 11 located on each side of the microstrip line 12 are of opposite handedness, they give rise to linear polarization of very high purity, especially in the axis of the antenna. In this case, in order to preserve the central frequency of the antenna, the perimeter of each annular slot is slightly less than $k'\lambda_s$ where $\lambda_s$ is the wavelength guided in the isolated slot.

Figure 3A:
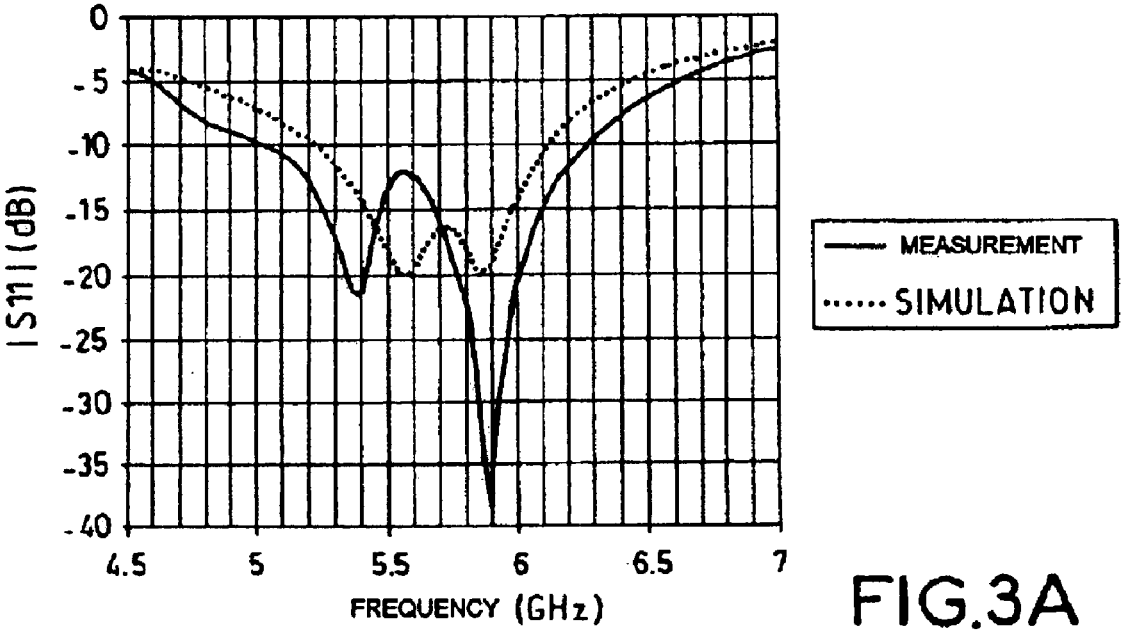
FIGS. 3A and 3B are, respectively, a curve giving the reflection coefficient S11, as a function of the frequency and the radiation pattern of an antenna system according to FIG. 3.
Figure 3B:
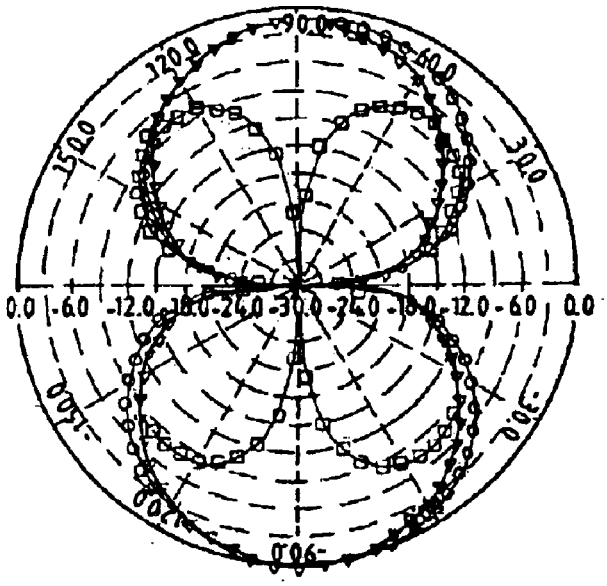

FIG. 3B shows the radiation patterns of the antenna system of FIG. 3 in the E and H planes at a central operating frequency of 5.7 GHz. Since the system is produced on the same type of substrate as the system of FIG. 1, it can be seen that the cross polarization is less than −19.1 dB, especially in the axis of the antenna.

FIG. 3A shows the reflection coefficient S11 of the system of FIG. 3 as a function of the frequency for a measurement and for a simulation. The antenna system is matched at −10 dB over 15.7% in simulation and 22% in measurement.

This type of device may be produced, for example, by using triplate technology on two substrates of permittivity $\epsilon_{r1}$ and $\epsilon_{r2}$. Thus, the two annular slots are etched on the top face of the first substrate. The supply line, made in microstrip technology, is produced between the two substrates and the earth plane is formed on the bottom face of the second substrate.

According to an additional feature of the invention, the two annular slots may be provided with perturbations transforming in a known manner a linear polarization into a circular one. More specifically, each annular slot is provided with two diagonally opposed perturbations, the perturbations being positioned at around 45 or 135 degrees from the plane passing through the centre of said means of transmission and the first point of symmetry. The perturbations may be done by cuts or by projections of various shapes, as known from the art.

An embodiment of the present invention making it possible to obtain radiation diversity will next be described with reference to FIGS. 4, 5 and 6. This radiation mode uses the basic structure described above.

Figure 4:
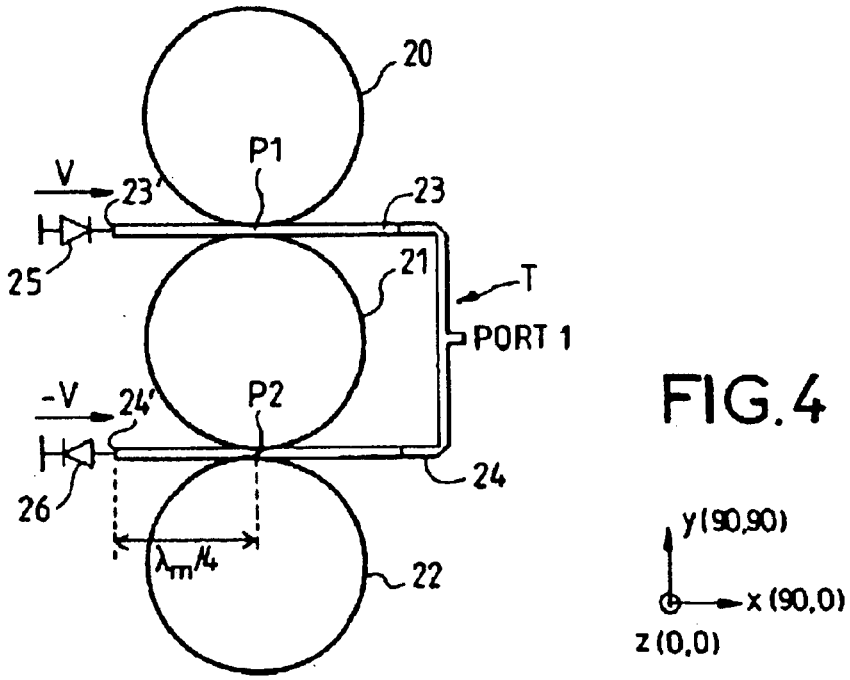
FIG. 4 is a schematic top plan view of a topology of an antenna system according to a second embodiment of the present invention.

As shown in FIG. 4, the novel topology of the electromagnetic signal transmission system consists of three antennas 20, 21, 22 of the annular slot type. These slots are tangent in pairs at the points P1 and P2. More specifically, the annular slots 20 and 21 are tangent at the point P1 while the slots 21 and 22 are tangent at the point P2. The points P1 and P2 are therefore points of symmetry through which a plane, more particularly a plane of tangency, may pass.

As shown in FIG. 4, the slots 20, 21, 22 are supplied by microstrip lines 23, 24 which are respectively in the planes of tangency passing through the points P1 and P2.

As shown in FIG. 4, the microstrip supply lines 23, 24 are joined by a T-shaped junction to the port 1 for connection with a supply circuit (not shown).

Furthermore, the length of line 23 or 24 between the point P1 or P2 and the end 23' or 24' away from the port 1 is preferably about $k\lambda_m/4$ where k is an integer and $\lambda_m$ the wavelength guided in the supply line.

As shown in FIG. 4, an electronic component making it possible to simulate a short circuit or an open circuit at the end of one of the lines and an open circuit or a short circuit at the end of the other line is mounted at the end of each of the lines 23, 24. More specifically, one diode 25 is reverse-mounted between the end 23' and the earth, while one diode 26 is forward-mounted between the end 24' and the earth. This mounting makes it possible to switch the radiation patterns between three states depending on the bias state of the diodes 25 and 26, this bias being produced in a manner known to a person skilled in the art. The various switching states are shown in Table 2 below:

TABLE 2

| | Diode state | |
|---|---|---|
| Applied voltage | Diode 25 | Diode 26 |
| −V | Off | On |
| 0 | Off | Off |
| +V | On | Off |

Figure 5:
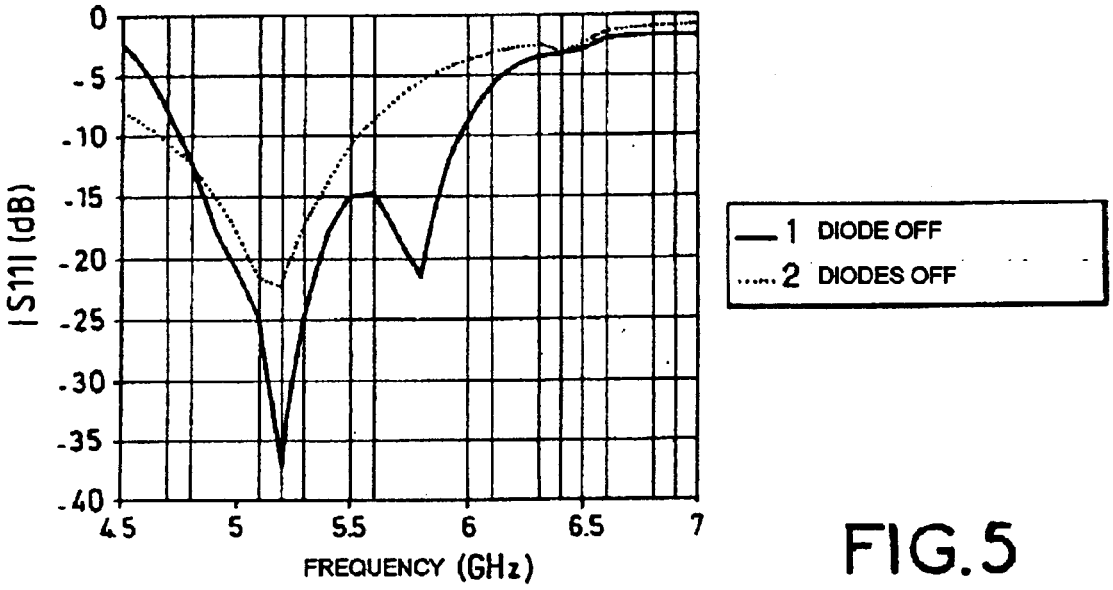
FIG. 5 is a curve giving the reflection coefficient S11 as a function of the frequency for the topology shown in FIG. 4.

From the structure of FIG. 4, a curve giving a reflection coefficient S11 as a function of the frequency is obtained, as shown in FIG. 5. On the basis of this curve, it will be noted that the matched bandwidth at −10 dB is 22% when a single diode is off, and 17.8% when both diodes are off.

Figure 6:
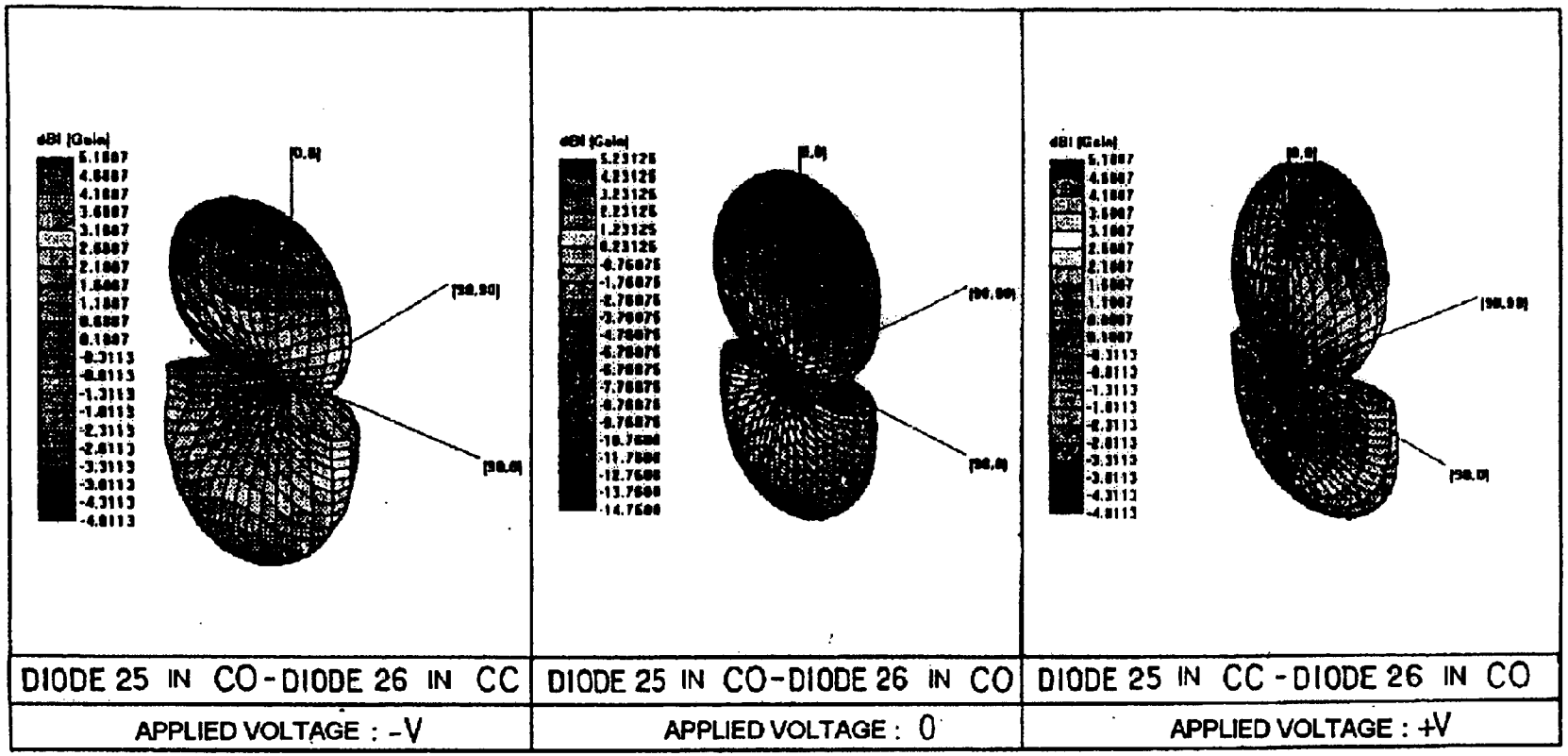
FIG. 6 shows the radiation of the three states of the antenna system of FIG. 4.

Furthermore, FIG. 6 shows the three radiation states of the antenna according to the states of two ideal diodes at an operating frequency of 5.4 GHz. Thus, radiation diversity of order 3 is obtained for the antenna device.

Figure 7:
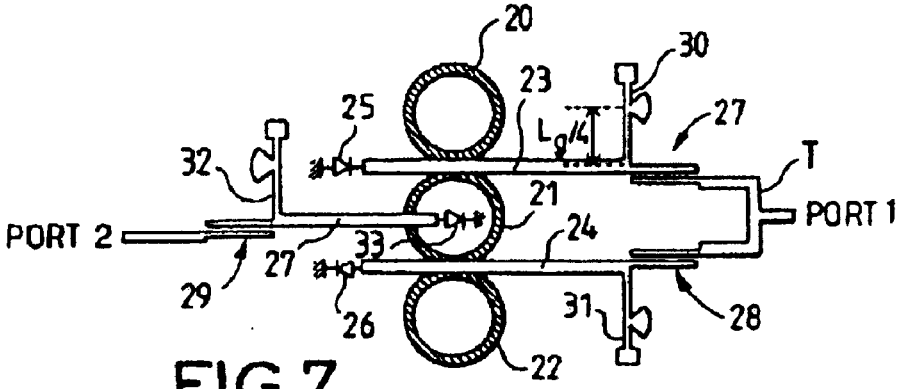
FIG. 7 is a schematic top plan view of another embodiment of the present invention.

To obtain a transmission channel with the antenna topology shown in FIG. 4, it is proposed, as shown in FIG. 7, to supply the central annular slot, that is to say the slot 21, by a microstrip line 27 positioned so as to produce a conventional line/slot transition as described by Knorr. This line is terminated by a diode 33 restoring a short circuit at the end of the line 27 in receiving mode.

To ensure maximum isolation between transmission and reception, the two diodes 25, 26 must be in the on state, that is to say have a short circuit at the end of the microstrip lines 23 and 24 in transmission mode, and the diode 33 must be in the off state, that is to say have an open circuit CO at the end of the line 27 in transmission mode. In this case, the system shown in FIG. 7 has four operating states, as mentioned in Table 3 below:

TABLE 3

| | | Diode state | | |
|---|---|---|---|---|
| | | Diode 25 | Diode 26 | Diode 33 |
| Rx | State 1 | Off | On | On |
| | State 2 | Off | Off | On |
| | State 3 | On | Off | On |
| Tx | State 4 | On | On | Off |

The control device making it possible to manage these four states is provided by a device independently controlling each of the three diodes. This control device consists, for example, of block devices 28', 28 mounted between the T-junction and the supply lines 23, 24. The block devices consist of DC-blocks of known type. A DC-block 29 is also provided between the line 27 and the port 2. Furthermore, line ends or "stubs" 30, 31, 32 are mounted between the respective lines 32, 24 and 27 and the terminal for biasing the various diodes 25, 26 and 33. The length of each radial line end is such that an open circuit is restored at the intersection point. In this way, the bias voltage is provided to each of the diodes, without disturbing the radiofrequency RF (transparency condition). Moreover, the DC-block device makes it possible to filter the DC current at the antenna access.

Figure 8:
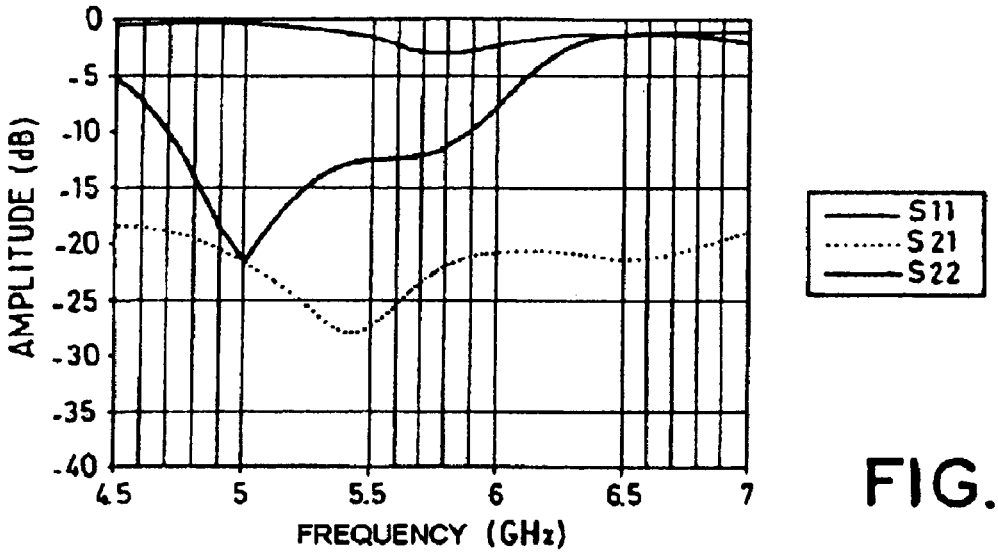
FIG. 8 is a curve giving the reflection coefficients of the antenna of FIG. 7 as a function of the frequency when the diodes 25 and 26 of FIG. 7 are in the on state, and the diode 33 in the off state.

With the system shown in FIG. 7, a curve giving the amplitude of the parameters S of the device as a function of the transmission frequency is obtained, that is when the diodes 25 and 26 are in short circuit in FIG. 8. It will be noted that, in this case, the matched bandwidth of the transmission channel is more than 22%.

Figure 9:
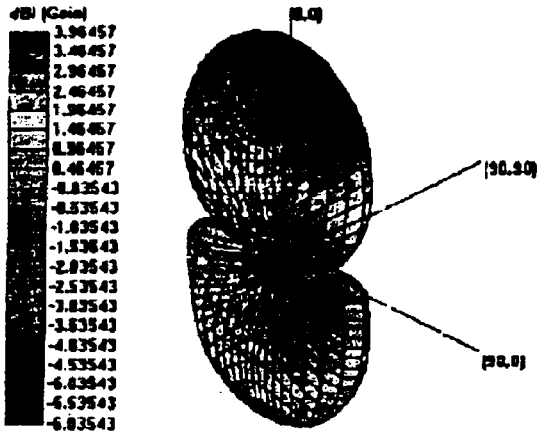
FIG. 9 shows the radiation pattern of the antenna of FIG. 7 when the diodes 25 and 26 of FIG. 7 are in the on state, and the diode 33 in the off state.

Furthermore, in transmission, a radiation pattern is obtained for the device, as shown in FIG. 9. On looking at the various radiation patterns, it will be noted that a high quality of linear polarization is obtained in the axis of the antenna. Furthermore, a good level of isolation is obtained between transmission and reception and the same polarization for transmission and reception. Furthermore, this compact antenna stretcher provides radiation pattern diversity of order 3.

It is obvious to a person skilled in the art that the above embodiments are given by way of example and may be modified in many ways. Thus, the slot may have a shape other than an annular shape; it may have a polygonal shape, that is a square or rectangular shape or the like. The supply lines may be produced in microstrip technology or in coplanar technology. The diodes may be replaced by other components such as transistors, electronic switches and microelectromechanical systems.

What is claimed is:

1. Antenna system for the transmission of electromagnetic signals comprising:

a first independent slot type antenna consisting of a closed curve, a second independent slot type antenna consisting of a closed curve, a first supply line, said first and second slot type antennas being symmetrically positioned on each side of said first supply line and being electromagnetically coupled by a line/slot transition to said first supply line, the transition being close to a short-circuit plane of the first supply line.

2. System according to claim 1, further comprising:

a third independent slot type antenna consisting of a closed curve, a second supply line connected in common with the first supply line to means for processing signals, the third slot type antenna and one of the first and second slot type antennas being symmetrically positioned on each side of said second supply line and being electromagnetically coupled by a line/slot transition to said second supply line, the first and second supply lines having each, a free end, the free ends being connected to a component simulating alternately a short circuit at one free end and an open circuit at the other free end.

3. System according to claim 2 wherein the slot antenna type supplied by a line/slot transition consists of annular slot and polygonal slot.

4. System according to claim 2, wherein the length of the supply line between the component and the transition is about $k\lambda_m/4$ where k is an integer and $\lambda_m$ the wavelength guided in the line, so as to restore an electrical short-circuit or open-circuit plane depending on the state of the component at the level of the transition.

5. System according to claim 2 wherein it further comprises a third supply line connected to one of the first, second and third slot type antennas by a line/slot transition.

6. System according to claim 5, wherein, in transmission mode, the components which are at the end of the first and second supply lines are supplied in order to simulate a short circuit.

7. System according to claim 6, wherein the component consists of a diode, a transistor, an electronic switch and a microelectromechanical system.

8. System according to claim 5, wherein the supply lines consist of microstrip lines and coplanar lines.

9. System according to claims 2, wherein the component consists of a diode, a transistor, an electronic switch and a micro-electromechanical system.

10. System according to claim 2, the wherein the supply lines consist of microstrip lines and coplanar lines.

11. System according to claim 1 wherein the slot antenna type supplied by a line/slot transition consists of an annular slot and or polygonal slot.

12. System according to claim 11, wherein the perimeter of the slot has a wavelength of about $k'\lambda_s$ where k' is an integer and $\lambda_s$ is the wavelength guided in the slot.

13. System according to claim 1, wherein the supply lines consist of microstrip lines and coplanar lines.

14. System according to claim 1, wherein the first and second slot antenna type are each provided with two perturbations, the perturbations being positioned at around 45 or 135 degrees from the plane passing through the centre of said slot antenna and the transition.

* * * * *